US008770161B2

(12) United States Patent
Gunnarsson

(10) Patent No.: US 8,770,161 B2
(45) Date of Patent: Jul. 8, 2014

(54) VALVE LIFT DEVICE FOR A COMBUSTION ENGINE

(75) Inventor: Niclas Gunnarsson, Huddinge (SE)

(73) Assignee: Scania CV AB (SE)

( * ) Notice: Subject to any disclaimer, the term of this patent is extended or adjusted under 35 U.S.C. 154(b) by 3 days.

(21) Appl. No.: 13/641,609

(22) PCT Filed: Apr. 12, 2011

(86) PCT No.: PCT/SE2011/050442

§ 371 (c)(1),
(2), (4) Date: Oct. 16, 2012

(87) PCT Pub. No.: WO2011/133088

PCT Pub. Date: Oct. 27, 2011

(65) Prior Publication Data

US 2013/0032109 A1 Feb. 7, 2013

(30) Foreign Application Priority Data

Apr. 19, 2010 (SE) ..... 1050381-1

(51) Int. Cl.
*F01L 1/34* (2006.01)

(52) U.S. Cl.
USPC ..... 123/90.16

(58) Field of Classification Search
CPC ..... F01L 2013/0063; F01L 1/146; F01L 1/18; F01L 13/0036; F01L 2105/00; F01L 1/181; F01L 13/0021; F01L 2001/054; F01L 1/182; F01L 1/183; F01L 1/185; F01L 13/0015; F01L 13/0026; F01L 13/0031; F01L 13/0047; F01L 13/0063
See application file for complete search history.

(56) References Cited

U.S. PATENT DOCUMENTS

| | | | | |
|---|---|---|---|---|
| 4,077,369 | A * | 3/1978 | Buehner | 123/90.16 |
| 5,253,621 | A | 10/1993 | Dopson et al. | 123/90.16 |
| 7,299,775 | B2 * | 11/2007 | Tateno et al. | 123/90.16 |
| 7,430,997 | B2 * | 10/2008 | Muraji et al. | 123/90.16 |
| 7,814,873 | B2 * | 10/2010 | Tateno et al. | 123/90.16 |

(Continued)

FOREIGN PATENT DOCUMENTS

| | | |
|---|---|---|
| EP | 0 262 256 | 4/1988 |
| JP | A S62-137313 | 8/1987 |
| JP | A S63-4313 | 1/1988 |

OTHER PUBLICATIONS

International Search Report mailed Jul. 19, 2011 in corresponding PCT International Application No. PCT/SE2011/050442.

(Continued)

*Primary Examiner* — Thomas Denion
*Assistant Examiner* — Daniel Bernstein
(74) *Attorney, Agent, or Firm* — Ostrolenk Faber LLP

(57) ABSTRACT

A valve lift device for a combustion engine, a camshaft (5), a first unit (16) with a first contact device (9) in contact with a guide surface on the camshaft (5), a motion-transmitting mechanism converting the lifting movement of the unit (16) to a lift of at least one valve (3) of the combustion engine. An adjusting device (20-22) allows linear movements of the first unit (16) and hence of the first contact device (9) in a plane which is perpendicular to the camshaft's rotational axis (5*a*) between at least a first position of contact (9*a*$_1$) with the guide surface (6) and a second position of contact (9*a*$_2$) with the guide surface (6).

9 Claims, 4 Drawing Sheets

(56) References Cited

U.S. PATENT DOCUMENTS

| | | | | |
|---|---|---|---|---|
| 8,307,806 | B2 * | 11/2012 | Mariano et al. | 123/321 |
| 2005/0092269 | A1 | 5/2005 | Harmon | 123/90.16 |
| 2007/0199529 | A1 | 8/2007 | Deane | 123/90.16 |

OTHER PUBLICATIONS

Office Action dated Oct. 29, 2013 issued in corresponding Japanese Patent Application No. 2013-506111 (English translation only).

* cited by examiner

VALVE LIFT DEVICE FOR A COMBUSTION ENGINE

CROSS-REFERENCE TO RELATED APPLICATIONS

The present application is a 35 U.S.C. §§371 national phase conversion of PCT/SE2011/050442, filed Apr. 12, 2011, which claims priority of Swedish Application No. 1050381-1, filed Apr. 19, 2010, the contents of which are incorporated by reference herein. The PCT International Application was published in the English language.

BACKGROUND TO THE INVENTION AND PRIOR ART

The present invention relates to a valve lift device for a combustion engine.

The inlet valves and exhaust valves of combustion engines are usually controlled by a rotating camshaft provided with cams which serve as guide surfaces for a cam follower. The cam followers therefore undergo substantially vertical lifting movements which are converted, via suitable motion-transmitting components, to lifting movements for the inlet valves and the exhaust valves. The opening and closing movements of the inlet valves and exhaust valves take place when the pistons in the combustion engine's respective cylinders are at fixed predetermined positions. The fixed positions for opening and closing the valves are a compromise arrived at to enable the engine to function well irrespective of its load and speed. The inlet valves and exhaust valves therefore do not always open and close at wholly optimum points in time in all operating conditions of the engine.

Controlling for example the closing time of the inlet valve may be advantageous from several points of view. Such control makes it possible to optimise the degree of filling of the cylinders at various different engine speeds, which is desirable when the engine is under heavy load. Controlling the inlet valve also allows control of the effective compression ratio. Postponing the inlet valve closing time relative to that which results in optimum degree of filling makes the compression begin later and therefore take place during a shorter proportion of the piston movement. The subsequent expansion does however remain unchanged. The result is that the expansion ratio is greater than the compression ratio, which in certain operating conditions is advantageous from an efficiency point of view. However, it is not possible to close the inlet valve late in all operating conditions. For example, when a combustion engine is being started up, the compression ratio would be so low that no ignition would take place.

A high exhaust temperature is often necessary to enable equipment for post-treatment of exhaust gases to work well. When there is low load upon the combustion engine, the air flow through it will be high relative to the amount of fuel supplied, resulting in a low exhaust temperature. The exhaust temperature may be raised by reducing the amount of air led to the engine. A throttle valve is normally used to reduce the amount of air led to the engine. However, using a throttle valve entails losses. Controlling the inlet valve closing time is an alternative way of controlling the air flow to the engine.

Control of the opening time of the exhaust valve may be used to raise the exhaust temperature. Opening the exhaust valve earlier than normal will end the expansion at a higher temperature, resulting in a raised exhaust temperature. In supercharged combustion engines, the exhaust turbine is so dimensioned as to be able to provide high charge pressure at low engine speed. This means that the turbine would over speed at high engine speed and load. To avoid this, part of the exhaust flow is led past the turbine through a so-called waste gate. The need for a waste gate may be reduced by postponing the opening time of the exhaust valve. This would also increase the efficiency.

In supercharged combustion engines, opening the exhaust valves early provides the exhaust turbine with more energy and consequent potential for higher charge pressure. Opening the exhaust valve late provides more energy to the engine, which therefore achieves greater efficiency. Variable exhaust valve opening times therefore make it possible to vary the efficiency and performance of the engine. During transients it may also be advantageous to open the exhaust valves later and thereby achieve a faster increase in charge air pressure.

SUMMARY OF THE INVENTION

The object of the present invention is to propose a valve lift device for a combustion engine which allows variable opening time and/or variable closing time for a valve which may be an inlet valve or an exhaust valve.

This object is achieved with valve lift devices of the invention. In this case the valve lift device thus comprises an adjusting device which allows movement of a contact device, in a plane which is perpendicular to the camshaft's rotational axis, to at least two different contact positions on the guide surface. When the camshaft rotates, the protruding portion comes in this case into contact with the contact device at various rotational positions of the camshaft. The lift of the unit and of the valve therefore take place at different stages. At stages where it is desired that the valve should open at an earlier time, the contact device is moved, by means of said adjusting device, along the guide surface, against the direction of rotation of the guide surface, to a new contact position in which the protruding portion comes into contact with the contact means earlier. If instead it is desired that the valve should close later, the contact device is moved, by means of said adjusting device, along the guide surface in the same direction as the direction of rotation of the guide surface, to a new contact position in which the protruding portion comes into contact with the contact device later. How much earlier or later the valve is lifted may be expressed as a camshaft angle difference with respect to an original opening angle or closing angle. The valve may therefore be an inlet valve or an outlet valve. In either case it is advantageous in certain operating situations to vary the closing time and/or the opening time.

According to a preferred embodiment of the present invention, the valve lift device comprises a second unit comprising a second contact device adapted to being in contact with a second peripheral guide surface on the camshaft, which second unit is adapted to undergoing a lift when the second contact device comes into contact with a protruding portion of the guide surface. The cam follower thus comprises two units, each with its contact device in contact with a separate guide surface. With suitable configuration of these units, one of them may be responsible for the valve opening movements and the other for the valve closing movements. The first guide surface and the second guide surface may be identical in shape. The guide surfaces have in this case a corresponding peripheral shape and protruding portions which are in phase with one another on the camshaft. It is nevertheless possible to use guide surfaces which are not of identical shape and which have protruding portions not in phase with one another on the camshaft.

According to another preferred embodiment of the present invention, said first and second units are connected to the motion-transmitting mechanism in such a way that the unit which at the time is subject to the higher lift of its guide surface transmits that lift to the valve. When the respective contact device of the units are in corresponding contact positions on the identically shaped guide surfaces, the units undergo a simultaneous lift. Moving the contact device of the first unit to an earlier contact position than that of the second unit provides the valve with an earlier opening time. Conversely, moving the contact device at the first unit to a later contact position than that of the second unit provides the valve with a later closing time. One of said units may be directly connected to the motion-transmitting mechanism and the other unit may comprise a contact portion adapted to entering into engagement with a contact portion on the directly connected unit, and to lifting the directly connected unit when said other unit reaches a higher lift than the directly connected unit. The contact portion of said other unit may at this stage be situated vertically below the contact portion of the unit which is directly connected to the motion-transmitting mechanism. When the directly connected unit has the higher lift, it transmits the lifting movement directly to the motion-transmitting mechanism. When the other unit has the higher lift, its contact portion comes into contact with that of the directly connected unit, thereby lifting the latter, which itself transmits the lifting movement to the motion-transmitting mechanism.

According to another preferred embodiment of the present invention, said adjusting device comprises a pivotable control spindle which is parallel with the camshaft and connected to the first unit via an articulated connection situated at a radial distance from the control spindle. When the control spindle is pivoted to various rotational positions, said unit is moved, via the pivotable connection, to various positions in a plane which is perpendicular to the control spindle and the camshaft. The contact device of the unit is thus moved to various contact positions on the guide surface in said plane. The control spindle may control the inlet valves or the exhaust valves in one, several or all of the combustion engine's cylinders. The adjusting device may comprise a power unit which turns the control spindle to various rotational positions, and a control unit which controls the power unit on the basis of information concerning the operation of the engine. The control unit may continuously receive information concerning relevant engine parameters and control the power unit so that the control spindle is continuously put into rotational positions at which the valve undergoes lifting at desired stages. The control unit may be a computer unit with suitable software for the purpose.

According to another preferred embodiment of the present invention, the second contact device of the second unit has a fixed position of contact with the guide surface. In this case the first contact device may be adjusted to various contact positions with respect to the second contact device of the second unit when the valve's opening time or closing time is to be adjusted. Alternatively, the valve lift device may comprise a second adjusting device adapted to allowing linear movements of the second unit and consequently of the second contact device in a plane which is perpendicular to the camshaft's rotational axis between at least two positions of contact with the guide surface. In this case the contact device of both units may be adjusted to desired contact positions on their respective guide surfaces. In this case it is possible to adjust both the opening time and the closing time for a valve.

According to another preferred embodiment of the present invention, said contact devices take the form of roller means adapted to rolling along the guide surfaces. The friction between the guide surfaces and the contact devices thus becomes minimal. Alternatively, the contact devices means may take the form of suitable slide means which slide along the guide surfaces. For the contact devices to be able to follow the guide surfaces with good precision, they abut with resilient force against the guide surfaces. The resilient force may be provided by a spring means which endeavours to keep the valve in a closed state.

BRIEF DESCRIPTION OF THE DRAWINGS

Preferred embodiments of the invention are described below as examples with reference to the attached drawings, in which.

DETAILED DESCRIPTION OF PREFERRED EMBODIMENTS OF THE INVENTION

Figure 1:
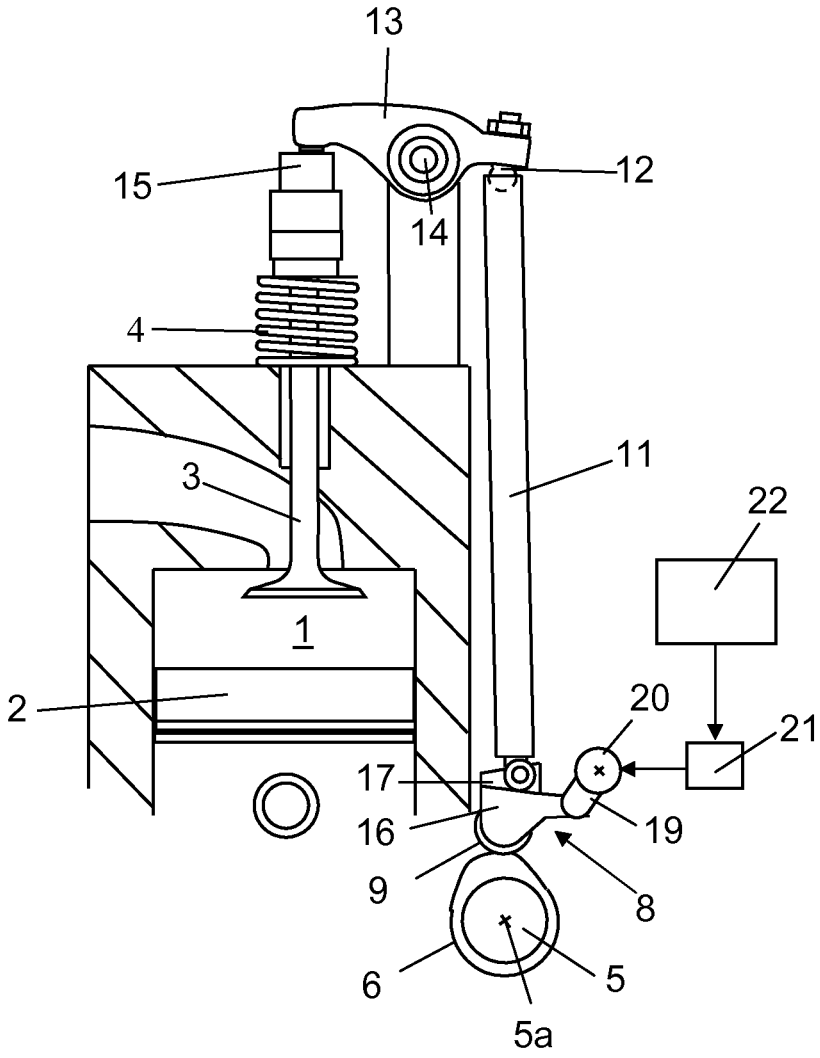
FIG. 1 depicts a valve lift device according to the present invention.

FIG. 1 depicts part of a cylinder of a combustion engine. The cylinder comprises a combustion space 1 defined by a movable piston 2. A valve 3 is visible in the cylinder. The valve 3 may be an inlet valve to control the supply of air to the combustion space 1, or an exhaust valve to control the evacuation of exhaust gases from the combustion space 1. Cylinders have in this case two inlet valves and two exhaust valves, although only one valve is visible in FIG. 1. Each of the valves 3 is connected to a valve spring 4 which endeavours to keep the valve 3 in a closed state. The combustion engine in this embodiment is provided with a low-level camshaft 5 which is rotatable at a speed related to the speed of the combustion engine. The combustion engine may alternatively be provided with one or more overhead camshafts. The camshaft 5 is rotatable about a rotational axis 5*a*. The camshaft 5 is provided with peripheral guide surfaces 6, 7, see FIG. 2. A cam follower 8 is adapted to being in contact with the guide surfaces 6, 7. The cam follower 8 comprises a first roller means 9 adapted to being in contact with the first guide surface 6, and a second roller means 10 adapted to being in contact with the second guide surface 7.

A pushrod 11 fitted substantially vertically has a lower end connected articulatedly to the cam follower 8, and an upper end connected articulatedly to a component 12 which is firmly mounted on a rocker arm 13. The upper articulated connection of the pushrod 11 comprises a spherical socket connected to a spherical portion of the component 12. The component 12 comprises an adjusting screw and a nut for adjustable fastening of the component 12 to a first end of the rocker arm 13. The rocker arm 13 is journalled pivotably at a middle portion about an articulation 14. The rocker arm 13 has at a second end, on the opposite side of the articulation 14, a contact surface adapted to being in contact with a valve yoke 15. FIG. 1 depicts the valve yoke 15 as seen from the side. The valve yoke 15 is adapted to transmitting control movements to two valves 3 in the cylinder 1. The pushrod 11, the component 12, the rocker arm 13 and the valve yoke 15 are components of a motion-transmitting mechanism whose purpose is to convert guiding movements from the cam follower 8 to opening and closing movements of the valves 3.

The cam follower 8 comprises a first unit 16 which itself comprises the first roller means 9. The first unit 16 has at one end an articulated connection 18 with two protruding connecting elements 19 firmly mounted on a rotatable control spindle 20. By turning the control spindle 20 and the connecting elements 19 it is possible to move the first unit 16 along the guide surface 6 in a plane which is perpendicular to the camshaft's rotational axis 5*a*. The control spindle 20 is turned to a desired rotational position by means of a schematically depicted power means 21 activated by a control unit 22. The power means 21 may be operated electrically, pneumatically or hydraulically. The control unit 22 may be a computer unit with suitable software. The cam follower 8 comprises also a second unit 17 connected to the pushrod 11. The second unit 17 comprises the second roller means 10. The first unit 16 comprises a contact portion with a contact surface 23. The second unit comprises a contact portion in the form of a contact roller 24 situated vertically above the contact surface 23.

Figure 2:
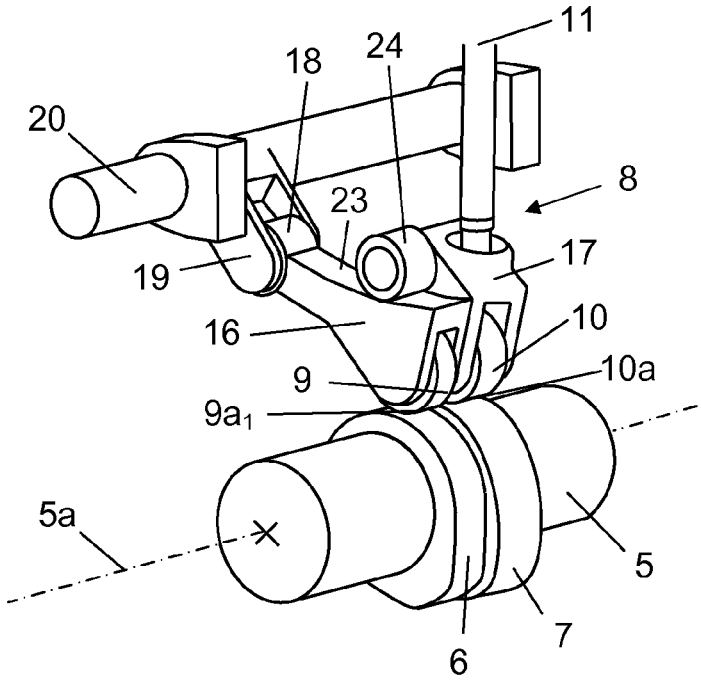
FIG. 2 depicts the cam follower in FIG. 1 in a first state.
Figure 3:
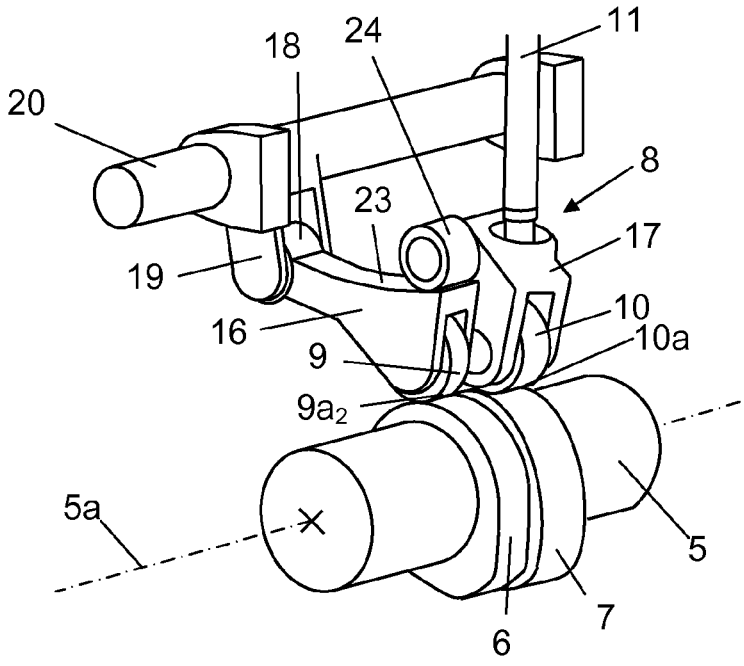
FIG. 3 depicts the cam follower in FIG. 1 in a second state.

By pivoting the control spindle 20 and the connecting elements 19 it is possible for the first roller means 9 to be positioned at various contact positions 9*a* on the guide surface 6. FIG. 2 depicts the control spindle 20 in a first rotational position. At this stage the connecting elements 19 of the control spindle 20 keep the first unit 16 in a position in which the first roller means 9 is in contact with the first guide surface 6 at a contact position $9a_1$ situated substantially directly above the rotational axis 5*a* of the camshaft 5. FIG. 3 depicts the control spindle 20 in a second rotational position. At this stage the connecting elements 19 of the control spindle 20 have moved the first unit 16 to a position in which the first roller means 9 is in contact with the first guide surface 6 at a second contact position $9a_2$. The second roller means 10 is thus in contact with the second guide surface 7. The second roller means 10 is so positioned as to always have contact with the second guide surface 7 at a contact position 10*a* situated substantially vertically above the rotational axis 5*a* of the camshaft 5. The control spindle 20 may control the inlet valves or the exhaust valves in one, several or all of the cylinders of the combustion engine.

Figure 4:
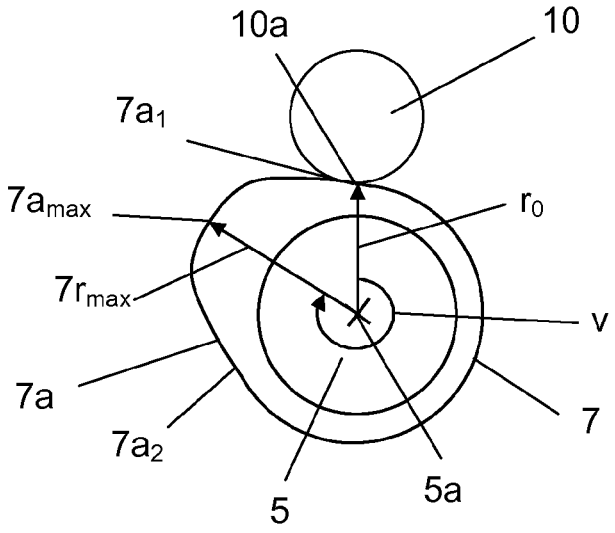
FIG. 4 is a side view of the second guide surface.

FIG. 4 depicts the second guide surface 7 in a plane which is perpendicular to the camshaft's rotational axis 5*a*. The second roller means 10 is here positioned on the second guide surface 7 at the contact position 10*a*. A radial axis $r_0$ extending from the rotational axis 5*a* to the contact position 10*a* is marked here. The guide surface 7 comprises a protruding portion 7*a* which has a surface situated at a greater radial distance from the camshaft's rotational axis 5*a* than the rest of the guide surface 7. The protruding portion 7*a* comprises an initial portion $7a_1$, a maximum portion $7a_{max}$ and a final portion $7a_2$. A radial axis $7r_{max}$ from the camshaft's rotational centre 5*a* to the maximum portion $7a_{max}$ is marked in the diagram. When the camshaft 5 rotates, the radial axis $7r_{max}$ will assume varying angles v relative to the radial axis $r_0$. This angle we define here as the angle v of the camshaft 5.

Figure 6:
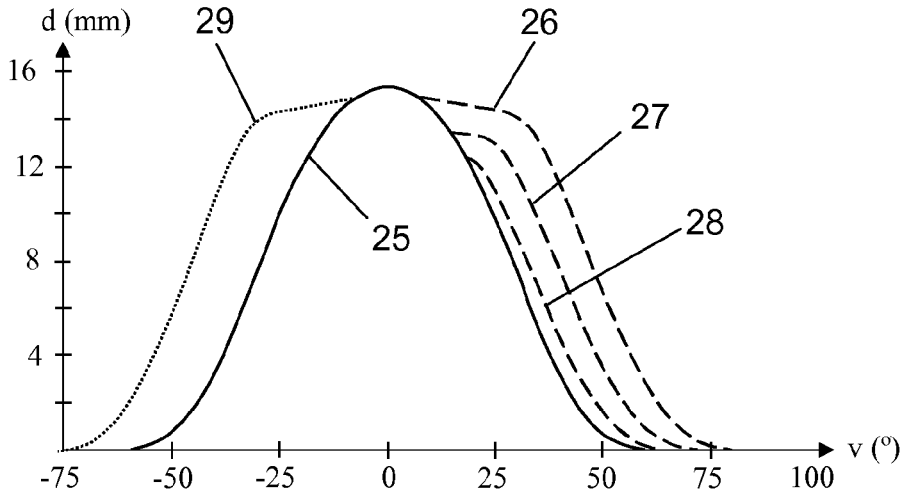
FIG. 6 depicts the valve lift of the valves as a function of camshaft angle.

In FIG. 6, a continuous curve 25 represents the lift d imparted to the valves 3 as a function of the camshaft angle v under the above definition. The valve lift d begins when the second roller means 10 comes into contact with the initial portion $7a_1$. The camshaft angle at this stage is about −50°, i.e. 310°. During continued rotary movement of the camshaft 5, the protruding portion 7*a* effects increasing lifting of the second roller means 10 and hence of the valves 3. When the maximum portion $7a_{max}$ comes into contact with the roller means 10, the valves 3 are at a maximum lift height. The angle v of the camshaft 5 at this stage is 0°. During continued rotation of the camshaft 5, the protruding portion 7*a* effects decreasing lifting of the second roller means 10. When the final portion $7a_2$ comes into contact with the roller means 10, the valves 3 are substantially closed. The angle v of the camshaft 5 at this stage is about 50°.

Figure 5:
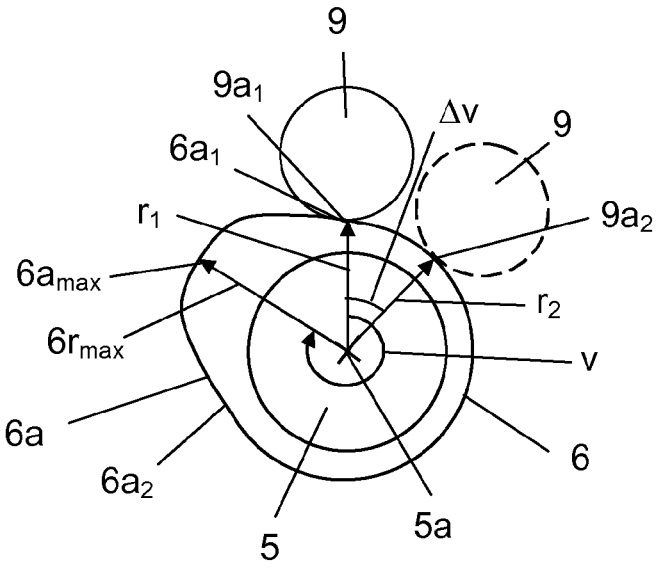
FIG. 5 is a side view of the first guide surface.

FIG. 5 depicts the first guide surface 6 in a plane which is perpendicular to the camshaft's rotational axis 5*a*. Like the second guide surface 7, the first guide surface 6 comprises a protruding portion 6*a* which has a surface situated at a greater radial distance from the camshaft's rotational axis 5*a* than the rest of the guide surface 6. The protruding portion 6*a* comprises an initial portion $6a_1$, a maximum portion $6a_{max}$ and a final portion $6a_2$. The first roller means 9 is therefore movable along the guide surface 6 in said plane to various positions of contact 9*a* with the guide surface 6. The first roller means 9 is here represented by a continuous line at the first contact position $9a_1$ as in FIG. 2, and by a broken line at the second contact position $9a_2$ as in FIG. 3. The first contact position $9a_1$ is thus situated substantially vertically above the camshaft's rotational axis 5*a*. A radial axis $r_1$ extending from the rotational axis 5*a* to the contact position $9a_1$ is marked in the diagram. A radial axis $6r_{max}$ extending from the camshaft's rotational centre 5*a* to the maximum portion $6a_{max}$ is also marked.

When the first roller means 9 is at the position illustrated by a continuous line in FIG. 5, it is at a contact position $9a_1$ on the guide surface 6 which corresponds to the contact position 10*a* of the second roller means 10 on the guide surface 7. The first roller means 9 undergoes at this contact position $9a_1$ a vertical lifting movement similar to the second roller means 10 during operation of the camshaft 5. The lift of the first roller means 9 begins when it comes into contact with the initial portion $6a_1$ of the protruding portion 6*a*. During continued rotary movement of the camshaft 5, the protruding portion 6*a* effects increasing vertical lifting of the first roller means 9. When the maximum portion $6a_{max}$ comes into contact with the roller means 9, it reaches a maximum lift height. During continued rotary movement of the camshaft 5, the protruding portion 6*a* effects decreasing vertical lifting of the first roller means 9. When the final portion $6a_2$ comes into contact with the roller means 9, the lift has substantially ended. When the first roller means 9 is at the first contact position $9a_1$, it thus effects lifting which corresponds exactly to the second roller means 10 at corresponding angles v of the camshaft 5. In this case the two units 16, 17 of the cam follower 8 effect identical lifts. The second unit 17 transmits the lifting movement to the valves 3 via the motion-transmitting mechanism 11-15. The contact surface 23 of the first unit 16 is in contact with the contact roller 24 of the second unit 17. Both the first unit 16 and the second unit 17 thus help here to impart a vertical movement upwards which is converted to lifting movements of the valves 3.

In situations where it receives information which indicates that it is appropriate to lengthen the lift of the valves 3, the control unit 22 activates the power means 21, which turns the control spindle 20 to the rotational position depicted in FIG. 3. The connecting elements 19 of the control spindle 20 here move the first unit 16 to a position in which the first roller means 9 makes contact with the first guide surface 6 at the contact position $9a_2$. During a subsequent operative process, the valve lift begins when the angle v of the camshaft 5 is −50°. At this stage, the second roller means 10 comes into contact with the initial portion $7a_1$. The protruding portion 7*a* lifts the second roller means 10 and the second unit 17. Since the contact roller 24 of the second unit 17 is situated vertically above the contact surface 23 of the first unit 16, the second unit 17 can effect lifting without the first unit 16 being affected. The first unit 16 transmits its lifting movement to the valves 3 via the motion-transmitting mechanism 11-15. The initial portion $6a_1$ of the first guide surface 6 has not yet reached the first roller means 9 because the first roller means 9 has moved to the contact position $9a_2$. Only when the camshaft 5 has rotated further and has reached an angle v of about −25° does the initial portion $6a_1$ come to the contact position $9a_2$ with the first roller means 9. During continued rotation of the camshaft 5, the protruding portion 6*a* effects lifting of the first roller means 9 and the first unit 16.

When the camshaft 5 reaches an angle v of 0°, the second roller means 10 has reached a maximum lift height. During further rotation of the camshaft 5, the second roller means 10 and the second unit 17 begin to drop downwards. A few degrees after the angle 0°, the first roller means 9, which in this situation is thus moving upwards, will reach the same height as the second roller means 10 which is moving downwards. At this stage the contact surface 23 of the first unit comes into contact with the contact roller 24 of the second unit. As it is situated vertically below the contact roller 24, the contact surface 23 ends the downward movement of the second unit 17. At this stage, the second roller means 10 loses contact with the second guide surface 7. The contact surface 23 of the first unit 16 keeps the second unit 17 in the almost maximum lifted state until the maximum portion $6a_{max}$ comes into contact with the roller means 9, which takes place when the angle v is about 25°. Once the maximum portion $6a_{max}$ has passed the first roller means 9, the first unit 16 and the second unit 17 drop downwards. The result is a closing movement of the valves 3. The closing movement ends when the final portion $6a_2$ comes into contact with the first roller means 9, which takes place when the angle v is about 75°.

In this case the valves 3 thus undergo an opening movement defined by the second unit 17 and a closing movement defined by the first unit 16. At the same time, the valves 3 are provided with a lengthened open period related to the angle difference Δv between the contact position 10*a* of the second roller means and the contact position 9*a* of the first roller means. In this case, when the first roller means 9 is at the contact position $9a_2$, the angle difference Δv is about 25°. Converted to crankshaft angles, this will be about 50°, since the crankshaft rotates twice as fast as the camshaft 5. The broken curve 26 represents the lengthened open period for the valves 3 when the first roller means 9 is at the contact position $9a_2$. It is possible, however, to move the first roller means 9 to one or more contact positions 9*a* between the contact positions $9a_1$, $9a_2$. The curves 27, 28 illustrate two examples of this. It is possible to turn the control spindle 20 so that the first roller means 9 can be put steplessly into any desired contact positions 9*a* between the contact positions $9a_1$, $9a_2$.

In the above embodiment, the closing time of the valves 3 is adjusted. The opening time of the valves can be adjusted in a similar way. The simplest way of doing so is by changing the direction of rotation of the camshaft 5. The dotted curve 29 in FIG. 6 represents an example in which the valves 3 open at an earlier time.

Figure 7:
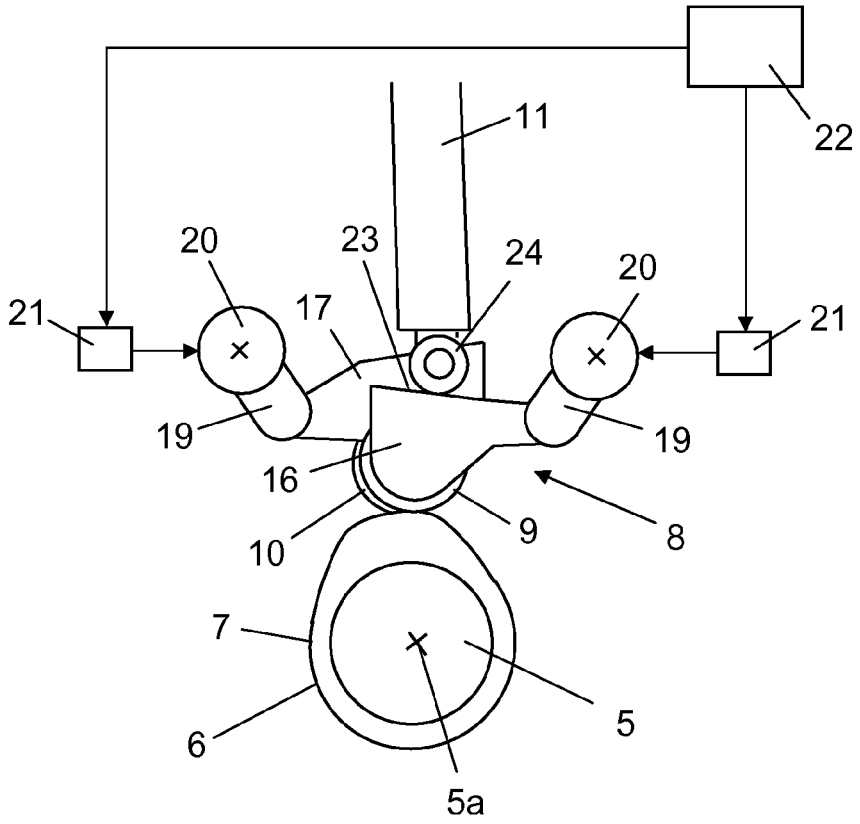
FIG. 7 depicts a valve lift device according to a second embodiment.

FIG. 7 depicts an alternative embodiment in which the two units 9, 10 of the cam follower 8 are movable in a plane which is perpendicular to the camshaft 5. The same components 19-22 are here used to adjust the roller means 9, 10 of the units 16, 17 to various contact positions on the respective guide surfaces 6, 7. We therefore give no further description of how this takes place. In this case both the opening time and the closing time for the valves 3 can be adjusted.

The invention is in no way limited to the embodiment to which the drawing refers but may be varied freely within the scopes of the claims.

The invention claimed is:

1. A valve lift device for a combustion engine, the valve lift device comprising:

a camshaft having a rotational axis;

a first guide surface on the camshaft, a first protruding portion on the first guide surface;

a first unit comprising a first contact device in contact with the first guide surface, the first unit is configured and operable for undergoing a lifting movement when the first contact device comes into contact with the first protruding portion of the first guide surface;

a motion-transmitting mechanism configured and operable for converting the lifting movement of the first unit for lifting at least one valve of the combustion engine;

an adjusting device configured and operable for allowing linear movements of the first unit causing linear movement of the first contact device in a plane perpendicular to the camshaft's rotational axis, between at least a first contact position of the first contact device on the first guide surface and a second contact position of the first contact device on the guide surface;

a second guide surface on the camshaft, a second protruding portion on the second guide surface;

a second unit comprising a second contact device in contact with the second guide surface on the camshaft, the second unit is configured and operable for undergoing a lifting movement when the second contact device comes into contact with the second protruding portion of the second guide surface;

wherein the first and second units are connected to the motion-transmitting mechanism in such a configuration that the one of the first and second units which at the time undergoes the higher lift of its guide surface transmits that lift to the valve;

wherein one of the units is directly connected to the motion-transmitting mechanism and the other unit comprises a contact portion entering into engagement with a contact portion of the directly connected unit for lifting the directly connected unit when the other unit undergoes a higher lift of the respective guide surface thereof than the guide surface of the directly connected unit.

2. A valve lift device according to claim 1, wherein each of the first and the second guide surfaces have a respective periphery in contact with the first and second contact devices.

3. A valve lift device according to claim 2, wherein the first guide surface and the second guide surface are of identical peripheral shape.

4. A valve lift device according to claim 1, wherein the adjusting device comprises a pivotable control spindle which is parallel with the camshaft and is connected to the first unit via an articulated connection which is situated at a radial distance from the control spindle.

5. A valve lift device according to claim 4, wherein the adjusting device further comprises a power unit configured and operable for turning the control spindle to a selected rotational position, and a control unit which controls operation of the power unit on the basis of information concerning operation of the combustion engine.

6. A valve lift device according to claim 1, wherein the contact device of the second unit is always in contact with the second guide surface.

7. A valve lift device according to claim 1, wherein the valve lift device comprises a second adjusting device configured and operable for allowing linear movements of the second unit and of the second contact device in a plane which is perpendicular to the camshaft's rotational axis between at least two contact positions on the guide surface.

8. A valve lift device according to claim 1, wherein the contact devices each comprise a respective roller device configured and operable for rolling along the respective guide surfaces.

9. A valve lift device for a combustion engine, the valve lift device comprising:

a camshaft having a rotational axis;

a first guide surface on the camshaft, a first protruding portion on the first guide surface;

a first unit comprising a first contact device in contact with the first guide surface, the first unit is configured and operable for undergoing a lifting movement when the first contact device comes into contact with the first protruding portion of the first guide surface;

a motion-transmitting mechanism configured and operable for converting the lifting movement of the first unit for lifting at least one valve of the combustion engine;

an adjusting device configured and operable for allowing linear movements of the first unit causing linear movement of the first contact device in a plane perpendicular to the camshaft's rotational axis, between at least a first contact position of the first contact device on the first guide surface and a second contact position of the first contact device on the guide surface;

a second guide surface on the camshaft, a second protruding portion on the second guide surface;

a second unit comprising a second contact device in contact with the second guide surface on the camshaft, the second unit is configured and operable for undergoing a lifting movement when the second contact device comes into contact with the second protruding portion of the second guide surface;

wherein the valve lift device comprises a second adjusting device configured and operable for allowing linear movements of the second unit and of the second contact device in a plane which is perpendicular to the camshaft's rotational axis between at least two contact positions on the guide surface.

* * * * *